US007797764B2

(12) United States Patent
Norris

(10) Patent No.: US 7,797,764 B2
(45) Date of Patent: Sep. 21, 2010

(54) MILITARY HELMET EXTENSION AND MILITARY HELMET INCLUDING THE EXTENSION

(76) Inventor: Richard G Norris, 1971 Ivy St., Denver, CO (US) 80220

( * ) Notice: Subject to any disclaimer, the term of this patent is extended or adjusted under 35 U.S.C. 154(b) by 1595 days.

(21) Appl. No.: 11/076,651

(22) Filed: Mar. 10, 2005

(65) Prior Publication Data

US 2010/0031409 A1 Feb. 11, 2010

(51) Int. Cl.
*A42B 1/24* (2006.01)
*A41D 13/00* (2006.01)
*A41D 27/26* (2006.01)

(52) U.S. Cl. ..... 2/422; 2/468

(58) Field of Classification Search ..... 2/410, 2/6.6, 421, 2.5, 468, 175.6, 209.13, 172
See application file for complete search history.

(56) References Cited

U.S. PATENT DOCUMENTS 1,364,662 A * 1/1921 Wagner ..... 2/410
2,374,675 A 5/1945 Freedman
2,888,681 A 6/1959 Stuart et al.
2,889,555 A 6/1959 Stuart et al.
3,046,560 A 7/1962 De Grazia
3,436,760 A 4/1969 Molitoris
3,591,863 A 7/1971 Rickard
3,668,706 A 6/1972 Velasquez
3,825,952 A 7/1974 Pershing et al.
3,873,997 A 4/1975 Gooding
4,843,642 A 7/1989 Brower
5,404,590 A * 4/1995 Monica, Jr. ..... 2/468
5,493,734 A 2/1996 Nieves-Rivera
6,163,891 A 12/2000 Viitalahti
7,124,449 B2 * 10/2006 Sutter et al. ..... 2/418
2004/0060100 A1 * 4/2004 Reiterman ..... 2/422

FOREIGN PATENT DOCUMENTS

WO PCT/HR99/00034 * 10/2000

* cited by examiner

*Primary Examiner*—Gary L Welch
*Assistant Examiner*—Amber R Anderson
(74) *Attorney, Agent, or Firm*—Leyendecker & Lemire LLC; Kurt Leyendecker

(57) ABSTRACT

In one embodiment of the present invention, a military helmet incorporating a neck shield extension is described. The neck shield extension is coupled to the body of the helmet using a plurality of elongated flexible straps. Accordingly, the neck extension moves upwardly whenever the wearer tilts his/her head back or to the side so that the wearer's head mobility is not hindered. The straps are comprised of a material having both a high tensile strength and tensile modulus that helps firmly hold the extension in place relative to the helmet when the extension is impacted with a ballistic projectile or other shrapnel.

20 Claims, 5 Drawing Sheets

MILITARY HELMET EXTENSION AND MILITARY HELMET INCLUDING THE EXTENSION

FIELD OF THE INVENTION

This invention generally relates to helmets and other head gear for providing ballistic protection to a wearer.

BACKGROUND

A modem military helmet for use by infantry troops is illustrated in FIGS. 1 and 2. Typically, these helmets 10 are fabricated from a Kevlar™/polymeric resin composite material that permits the helmet to be relatively light in weight while providing good ballistic protection from bullets, shrapnel and other debris that might otherwise injure an unprotected soldier. As can be seen in the prior art figures, the helmet provides protection for: (i) the front of a wearer's head above his/her eyes; (ii) the sides of the head above the bottom of the user's ears; (iii) the back of the head generally just above the intersection of the head with the wear's neck; as well as (iv) the top of the head.

Modem helmets provide little or no protection for the sides 14 and nape 12 of the neck. Further, body armor worn by some troops to provide ballistic protection to the torso does not extend upwardly to cover the neck. Helmets can and have been produced that provide greater neck protection by extending the length of the back and sides of the helmet; however, this severely reduces the head mobility of the user, particularly his ability to tilt his head to the side or rearwardly. Firing a weapon in the prone position would be difficult if not impossible as the extended back side would either prevent the wearer from tilting his head up or cause the helmet to be shifted over his eyes hindering his view of the battlefield. Further, such an extended helmet would not permit the wearer to look skyward to watch for threats from above. Accordingly, helmets having extended side and rear portions are not used by modem military troops. Simply, the limitations to head mobility have been determined to be such a hindrance and detriment to a soldier as to outweigh the benefits of providing additional ballistic protection to the soldier's neck.

Several improvements to the military helmet have been proposed to provide additional protection to the lower portion of a wearer's head and the wearer's neck as indicated in U.S. Pat. Nos. 3,046,560, 2,888,681 and 3,436,760. Further, non-military helmets for vocational and recreational activities have been proposed to provide additional protection to the neck and lower back portions of the head as indicated in U.S. Pat. No. 3,873,997.

U.S. Pat. No. 3,046,560 describes an armored curtain that extends from the brim to protect the wearer's neck. Preferably, the curtain portion is substantially stiff to provide ballistic protection, but it is attached to the helmet flexibly by the way of fabric material to allow the curtain to move upwardly, such as when a wearer assumes a prone position (see FIG. 3). As shown, the curtain is part of a helmet cover that fits over a traditional WWII or WWI style helmet. While this configuration does potentially provide a wearer with additional ballistic protection for the neck, it is cumbersome comprising a cover that must be fitted over the helmet. Further, the extreme flexibility of the extended curtain portion limits its effectiveness in deflecting debris. For instance, debris of sufficient velocity and momentum could cause the curtain to be driven into the wearer's neck causing the wearer injury.

U.S. Pat. No. 2,888,681 describes a helmet having a neck and ear shield that is coupled to the helmet body by pivotal connections located directly above a wearer's ear. The extension will tilt upwardly if the wearer tilts his head back but it will not retract upwardly if the wearer moves his head to the side. A flange 19 is provided to prevent the unintended downwardly movement of the extension beyond its fully extended position. It is noted that even with the neck and ear shield, the amount of protection offered by this helmet is similar to the standard issue military helmet. It is appreciated that this helmet's general design could be modified to provide additional neck protection but such a modification would hinder the ability of a wearer to move his head side to side even more.

U.S. Pat. No. 3,436,760 describes an extension to a steel helmet that comprises fiberglass or some other suitable ballistic material and hangs beneath the brim of the helmet to protect the back and sides of the wearer's neck. The extension, however, is not designed to move upwardly such as when the wearer assumes a prone position. Rather, the extension flares outwardly and its bottom edge curves upwardly along its backside to provide the wearer with the ability to tilt his head somewhat. While providing additional ballistic protection over a standard military helmet, it still leaves a significant portion of the nape of the neck exposed when the wearer is in an upright position as is necessitated to permit the wearer to assume a prone combat position. Additionally, the side portions of the extension hinder the ability of a wearer to freely tilt his head to either side.

U.S. Pat. No. 3,873,997 describes a helmet having an extension offering supplemental protection to the lower portion of the back of the head and the upper portion of the nape of the neck, although this helmet is not intended for military use but rather for sports or industrial protection. The extension is designed to move upwardly when the wearer moves his/her head rearwardly by rotating about pivot 16, but it does not appear to be capable of moving upwardly when a wearer tilts his/her head to the side. Further, the length of the extension does not appear to be as substantial providing no more protection than a standard issue military infantry helmet.

DETAILED DESCRIPTION

Figure 1:
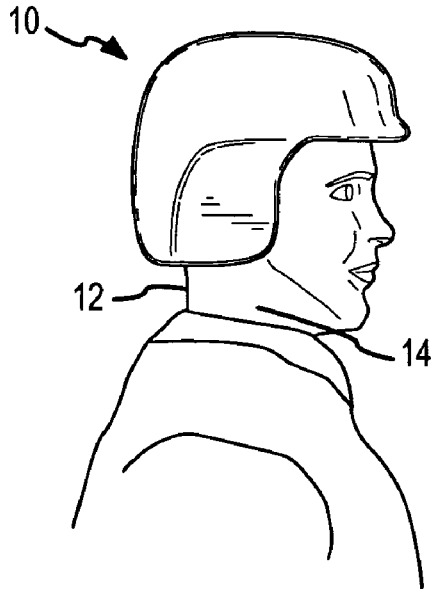
FIG.1 (PRIOR ART)
FIG. 1 (prior art) is a side view of a modem military helmet on the head of a wearer.

One embodiment of the present invention comprises a helmet extension that can be retrofitted to a modem military helmet for providing additional ballistic protection for a wearer's nape of the neck and the lower portion of the back of the head. Another embodiment of the present invention comprises a helmet incorporating the extension. The extension, which is generally U-shaped, is substantially rigid being typically comprised of the same Kevlar™-based composite material as the helmet. In its normal position, the extension overlaps the rim of the helmet at its back and sides and extends downwardly therefrom a sufficient distance to provide effective protection of the back and sides of the wearer's neck when the wearer is in an upright standing position. Proximate the bottom rim of the extension, the extension flares outwardly somewhat.

The extension is coupled to the helmet using a plurality of generally flexible high tensile strength straps or cables that are resistant to elastic or plastic elongation. In one variation, the straps are comprised of a woven Kevlar™ material that unlike the helmet and extension composite has not been impregnated with a rigid polymeric material. One end of each of the straps is attached to the helmet at various locations around the sides and back of the helmet at a distance above the top edge of the extension typically by way of a bolt or rivet. The other end of each strap is attached to the extension generally proximate its top edge, accordingly the extension hangs from the straps. As is described in greater detail below, the straps inhibit and substantially prevent the extension from being pushed inwardly towards the wearer's head when the extension is subject to a high energy impact, such as from a ballistic projectile or shrapnel. Advantageously, however, the flexible straps buckle and fold when the extension is pushed upwardly thereby permitting, not hindering, the ability of a wearer to tilt his head from side to side or look up when in a prone position.

In preferred variations of the extension, at least a portion of the inside surface of the extension includes a plurality of spaced ridges that extend circumferentially and generally horizontally. The ridges act to prevent the extension from being driven upwardly by bracing against the lower rim of the helmet. Accordingly, a wearer's neck does not become exposed when the extension is subject to a high energy impact. Further, through the interaction between a ridge and the lip during an impact, a portion of the energy or load incident on the extension during the impact is transferred to and dissipated through the helmet.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The terms "strap" or "straps" as used herein to refer to the elements connecting the extension to the helmet are intended to include not only straps but any elongated element that is generally flexible, or in other words, has a low resistance to buckling when subject to compressive loads. For instance, as used herein a strap could comprise a multifilament cable.

The term "Kevlar™" as used herein is not intended to be limited in meaning to the fibrous material produced by DuPont of Wilmington, Delaware to which the trademark term typically applies, but is intended to encompass all aramid fibrous materials having similar properties as DuPont's Kevlar™.

The term "ballistic material" as used herein refers to any material in a suitable configuration to resist penetration by ballistic projectiles, shrapnel and other combat related debris.

One Embodiment of a Helmet

Figure 3:
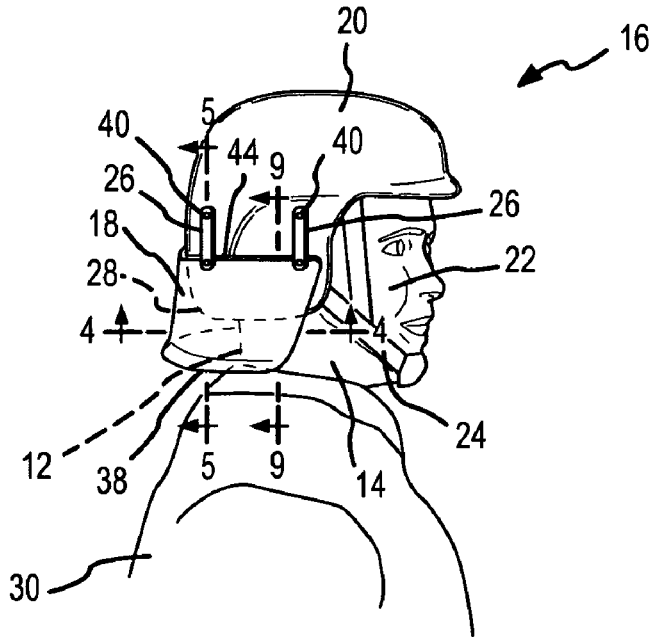
FIG. 3 is an isometric side view of a helmet incorporating a helmet extension shown on the head of a wearer according to one embodiment of the present invention.
Figure 4:
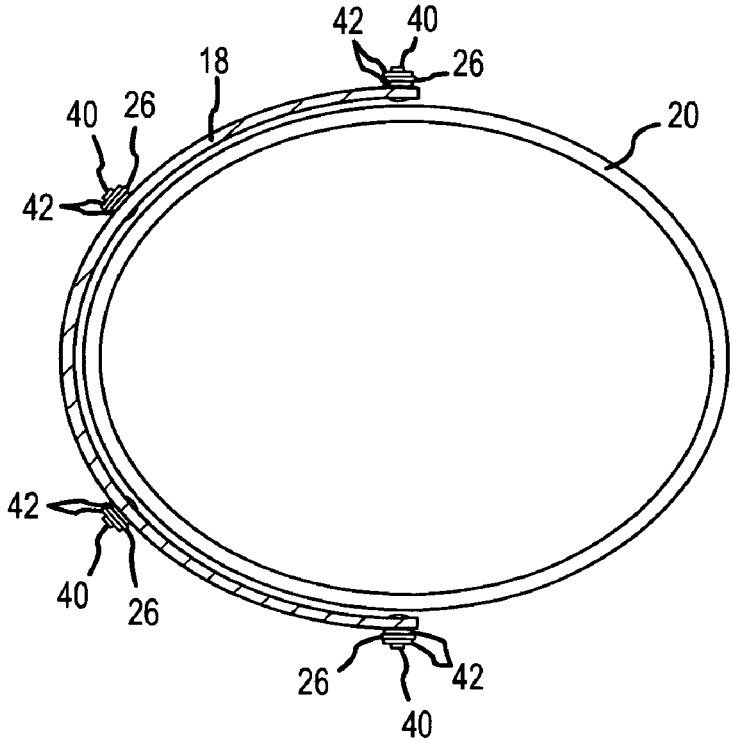
FIG. 4 is a cross sectional bottom view of the helmet taken along line 4-4 of FIG. 3 according to one embodiment of the present invention sans the headband suspension assembly which is not illustrated in this view.
Figure 5:
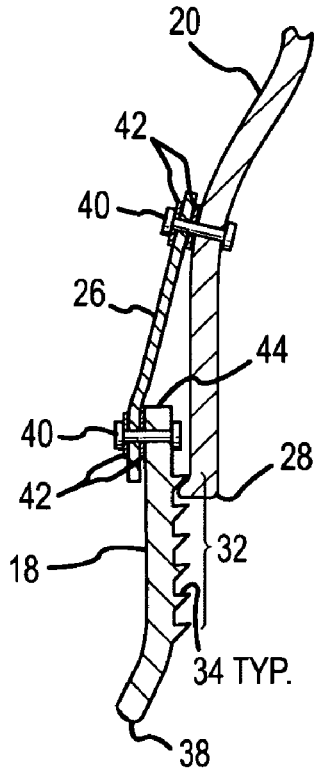
FIG. 5 is a partial cross sectional view taken along line 5-5 of FIG. 3 illustrating a portion of the helmet and the helmet extension according to one embodiment of the present invention.

Referring to FIGS. 3-5, one embodiment of a helmet 16 incorporating a neck shield 18 to provide a wearer with additional neck protection is illustrated.

The main body of the helmet typically comprises a rigid shell 20 that is designed to fit over the top of a wearer's head 22. The shell can be described as being generally hemispherical in shape and configuration, although the shell is actually somewhat oblong and includes side portions that project slightly outwardly and downwardly from the main body portion of the shell to provide both room and protection for the wearer's ears.

Figure 2:
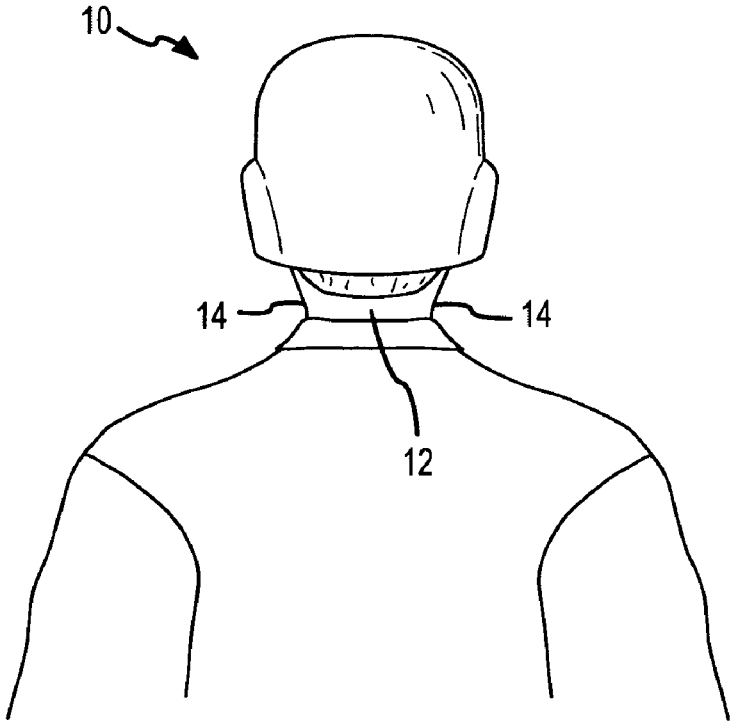
FIG.2 (PRIOR ART)
FIG. 2 (prior art) is a rear view of a modem military helmet on the head of a wearer.

The interior cavity formed by the shell is somewhat larger than the head of a wearer. Accordingly, a headband suspension assembly (not illustrated) of conventional construction and configuration is provided to cradle the wearer's head 22 as well as suspend the shell off of the wearer's head a small distance. The headband suspension assembly is typically riveted to the shell although in variations it can be attached to the shell by any suitable means including threaded bolts, snaps and hook and loop material. A chin strap 24 is coupled to the headband suspension assembly. As illustrated in FIG. 3, the shell essentially covers the top of the wearer's head above the eyes in the front, over the ears on the sides and terminates just above the intersection of the neck and the back of the head in the rear. In variations of the helmet, the shell 20 and the associated headband suspension assembly can comprise a standard issue military helmet 10, such as the one illustrated in FIGS. 1 and 2.

The shell 20 is typically comprised of a ballistic material, such as but not limited to a Kevlar™ composite. Kevlar™ is a registered trademark of the DuPont Corporation and refers to a high modulus high strength synthetic aramid fiber. Other aramid fibers manufactured by companies other than Dupont Corporation can be used in place of Kevlar™. A typical Kevlar™ composite comprises a plurality of layers of Kevlar™ fabric or unwoven Kevlar™ material that is laminated with a thermoset or thermoplastic resin to impart rigidity to the resulting structure. One type of thermoset resin used in Kevlar™ composite structures and variations of the shell is epoxy. Further, the Kevlar™ fibers can be intermingled with other types of reinforcing fibers such as but not limited to carbon fibers, ultra high strength polyethylene fibers (i.e. Spectra™ produced by Honeywell corporation), liquid crystal fibers (i.e. Vectran™ produced by Celanse Acetate LLC of Charlotte, N.C.), and fiberglass fibers. The shell can also be produced comprising any suitable combination of the aforementioned fibers or other high strength fibers to impart the desired ballistic properties to the resulting shell. The shell can also comprise a metallic material such as steel, which was commonly used in older style military helmets. Other metallic materials, either unreinforced or reinforced with ceramic fibers, can be used as well. It is appreciated that many types of materials can be used in a shell that provides an adequate degree of ballistic protection.

The actual configuration of the shell 20 can vary significantly and the shell illustrated in the figures is to be considered merely exemplary. Shells can vary substantially depending on the intended function of the associated helmet and the conditions to which the wearer is to be subjected. For instance, helmets worn by combat troops typically cover a greater portion of a wearer's head and offer superior ballistic protection when compared to helmets worn by the flight deck crew on an aircraft carrier since the combat troops are much more likely to be subject to situations wherein the helmet might incur a high energy impact.

The generally horseshoe-shaped rigid neck shield 18 freely hangs from the shell and is coupled to the shell by way of a plurality of elongated straps 26. The neck shield is fabricated of the same or similar ballistic materials as the shell, such as but not limited to Kevlar™ and other fiber reinforced composites and metallic materials. The neck shield partially overlaps the shell's back exterior surface and at least portions of the shell's left and shell's right exterior surfaces proximate the bottom rim 28. The shield typically hangs beyond the bottom rim of the helmet's shell a sufficient distance to nearly completely cover the nape 12 of a wearer's neck when worn, as well as a substantial portion of the wearer's sides 14 of the neck. Advantageously, when the wearer tilts his head 22 rearwardly relative to his torso 30, such as when assuming a prone position, the extension is pushed upwardly and does not hinder his visibility (see FIG. 6). Further, unlike several prior art helmets, the neck shield of the one embodiment helmet retracts when the wearer to tilts his head to either side (see FIG. 7).

The dimensions of the neck shield 18 are sufficiently larger than corresponding dimensions of the shell 20 to facilitate free upwardly movement of the neck shield relative to the shell as best shown in FIG. 4. For instance, the distance between the left and right sides of the interior surface of the neck shell is a sufficient amount greater than the distance between the corresponding exterior left and right exterior surfaces of the shell so that the neck shield does not become wedged against the shell when a wearer tilts his head to one side. It is appreciated that if the aforementioned distances are too close to each other, the neck shield would not retract completely when a wearer attempted to tilt his head to either the right or the left and might even become wedged in place. As an example, in order for the neck shield to freely retract upwardly 2.0" on one side of the shell that has a distance between the exterior side surfaces proximate and covering the ears of 8.5", the corresponding distance between the interior side surfaces of the neck shield should be at least about 0.2" greater and for 3.0" of retraction the distance between the interior surfaces of the neck shield should be at least about 0.5" greater.

Figure 7:
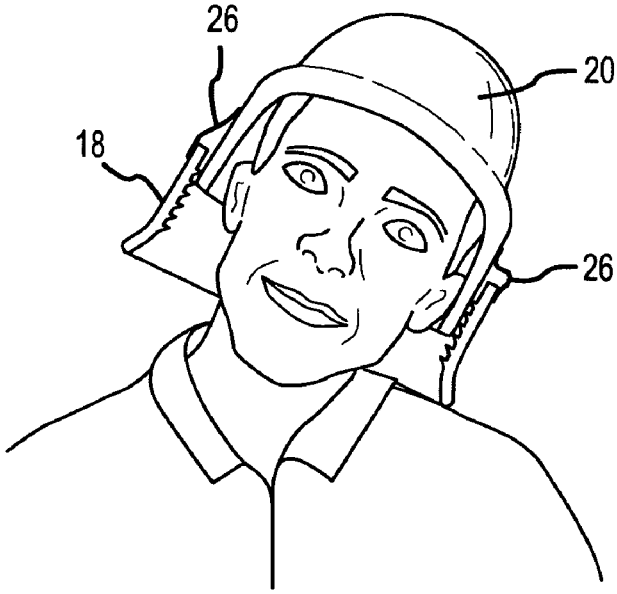
FIG. 7 is a view of a soldier wearing the helmet bending his helmet to one side according to one embodiment of the present invention.
Figure 8:
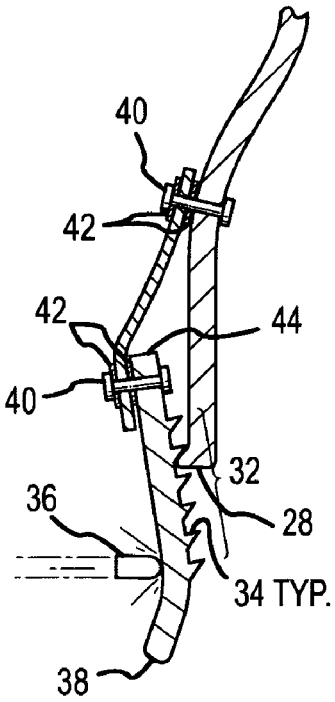
FIG. 8 is a partial cross sectional view of the helmet and extension indicating the movement and deflection of the extension when subject to a ballistic impact according to one embodiment of the present invention.

Referring particularly to FIGS. 5 and 8, a cross section of the neck shield 18 is illustrated. As shown, a plurality of vertically-spaced ridges 32 extends substantially horizontally around the interior surfaces of the neck shield. Typically, the ridges are evenly spaced from each other over a substantial portion of the interior surface. Each ridge comprises a generally horizontally orientated top surface 34. As shown in FIG. 7, the top surface of one of the ridges is driven against the bottom rim 28 of the shell 20 when the neck shield is impacted by a projectile, shrapnel or other debris. The top surface braced against the bottom rim provides a fulcrum about which the shield rotates or pivots a short distance until the associated strap(s) 26 are sufficiently tensioned to prevent any more inwardly movement of the shield. Depending on the impact angle and energy of a projectile 36, it could cause a neck shield with a smooth interior surface to slide or move upwardly thereby exposing a wearer's neck to other projectiles and debris. The ridges 32 in conjunction with the rim of the shell effectively reduce the likelihood that an impact will cause the shield to move upwardly and accordingly, maximize the protection of a user's neck. Variations of the helmet do not have ridges and in other variations only a single ridge is utilized. Further, the size and configuration of the ridge(s) can vary significantly depending on: the construction of the neck shield; the materials used in the neck shield; and the estimated impact loads the shield is designed to resist.

Referring to FIGS. 3 and 5, the neck shield 18 when being worn by a wearer in an upright standing position has a generally vertical orientation. However, in certain variations and embodiments, the portion of the shield proximate the shield's bottom edge flares outwardly. Typically, the bottom edge 38 of the shield at the tip of the flared portion is displaced about 0.25" to 1.00" from a vertical plane formed by the generally vertical upper portion integral therewith. The flaring minimizes the risk that the end of the neck shield will be driven into the nape 12 of a wear's neck when the shield is impacted from behind by a projectile 36 as the greatest horizontal displacement of the shield occurs at its bottom edge (See FIG. 8). Additionally, the flare helps to direct debris and shrapnel that impacts the shield from impacting the wearer's body by deflecting it outwardly. The amount of flare to the shield should be sufficient that when the helmet is impacted and the straps are fully tensioned as in FIG. 8, the flared portion should be at least vertically orientated and preferably flared outwardly of the wearer's neck.

As previously described the neck shield is suspended from the shell and hangs freely therefrom by way of a plurality of flexible straps 26. In the illustrated embodiment as best shown in FIGS. 3 and 4, four straps are provided: one on the left side of the helmet; one on the right side of the helmet; and two on the back portion of the helmet. In variations more straps can be used and in another variation only three straps can be used. However, the use of at least four straps as configured in FIG. 4 is considered most advantageous as the energy from any impact will be distributed between at least two straps. Furthermore, a strap of the four can be damaged without rendering the neck shield assembly ineffective.

Figure 6:
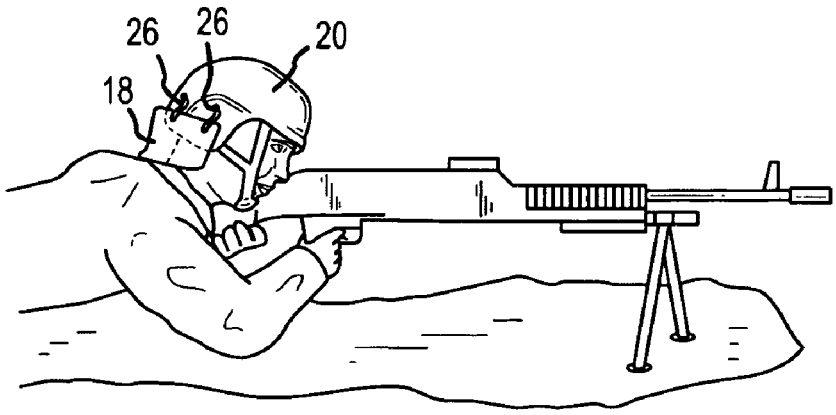
FIG. 6 is a view of a soldier wearing the helmet in a prone position according to one embodiment of the present invention.

In one embodiment the straps are comprised of a woven Kevlar™ material that is not impregnated with a resin and accordingly is relatively flexible. In such a configuration, the strap has extremely good tensile strength and tensile modulus but easily buckles or folds when compressively deformed. In other words, when the shield 18 is pushed upwardly, the straps located proximate the upwardly moving portion of the shield present little resistance to the movement but rather buckle and fold. Accordingly, the wearer's ability to tilt his head rearwardly relative to his torso 30 as shown in FIG. 6 is not hinder by the neck shield and/or straps. Additionally, the straps and neck shield provide little hindrance to the wearer's ability to tilt his head to either side. The straps can comprise other materials including: (1) straps woven, twisted or braided using one or more of the other fibers described above; (2) straps comprising woven, twisted or braided thin metallic wire; and (3) other synthetic or natural fibrous materials such as nylon, polypropylene, silk and cotton. However, if lower strength fibers, such as cotton and nylon, are used, the strap must be made thicker and/or wider to be able to accommodate similar loads as the straps made of Kevlar™ and other reinforcing fibers. Ultimately, the straps must be made to a sufficient strength to withstand breaking or failing when tensioned by an impact against the neck shield, such as shown in FIG. 8. Of similar importance, the straps must not stretch appreciably when tensioned so the neck shield does not rotate so far under impact wherein it contacts the wearer's neck, possibly causing a neck injury through an indirect transfer of a projectile's impact energy.

In certain variations, wherein Kevlar™ or another organic fiber strap is utilized, the strap can be coated with a flexible UV opaque material, such as opaque polyurethane or vinyl material. The tensile strength of organic fibers in general and Kevlar™ and other aramid fibers in particular degrade when exposed to ultraviolet radiation for extended periods of time, although the fibers retain their tensile modulus. Since military helmets are typically worn outdoors, a coating would inhibit the premature degradation of the straps ensuring their viability in critical situations, such as combat.

The top end of each strap is attached or coupled to the helmet using a suitable attachment means such as but not limited to one or more rivets 40, one or more threaded fasteners, a buckle fixedly secured to the shell or integrally formed therein, adhesive bonding, hook and loop connectors and snap connectors. It is appreciated that the strength of the attachments must be of sufficient strength to handle the potential loads generated by an impact without failing. Accordingly, washers 42 sandwich the strap in the variations utilizing a threaded fastener or rivet to more evenly distribute the load transfer from the strap into the shell through the rivet or threaded fastener. The bottom end of each strap is attached or coupled to the shell also using an attachment means such as but not limited to those disclosed above.

In other variations, the straps can be replaced with other suitable connectors that perform in a similar manner to the straps. For instance, rigid telescoping rods can be utilized wherein the sections of the rods retract when subject to an upwardly force but are fully extended when the neck shield 18 is in its fully extended free hanging position. In another variation, articulated linkages can be utilized wherein two or more links of each linkage are fully extended when the neck shield is free hanging and the links pivot relative to each other about their connections with each other when subject to an upwardly force permitting the shield to retract upwardly.

Concerning the geometry of the straps and their respective mounting locations on the shell and the neck shield, the bottom end of each strap is preferably mounted to the neck shield at a location proximate the top edge 44 thereof to help ensure the neck shield hangs generally vertically from the straps. However, the straps must be mounted vertically above a horizontal plane passing through the shields center of gravity for it to hang properly off of the shell. The top end of each strap is coupled and attached to the shell at a mounting location such that the distance between the top edge of the shield and the mounting location is at least as great as the maximum amount of vertical shield retraction. Preferably, the maximum amount of retraction is equal to the vertical distance between the bottom rim of the shell and the bottom edge of the neck shield such that when full retracted the bottom rim and bottom edges are roughly horizontally-aligned with each other. In a helmet designed for use by combat troops, the distance between the bottom rim and bottom edges is typically about 2.5-4.0" depending on the size of the helmet and the desired amount to protection provided by the helmet.

As described earlier and as illustrated, the neck shield 18 overlaps the portion of the shell 20 proximate the shell's bottom rim 28. The greater amount of overlap, the greater amount of leverage each strap has about the fulcrum of the bottom rim of the shell and the associated horizontally-extending ridge 32 in contact therewith when the neck shield is subject to an impact as shown in FIG. 8. Effectively, more overlap reduces the amount of inwardly pivotal movement of the neck shield towards a wearer's neck when the shield sustains an impact of a certain amount of energy. However, as the amount of overlap is increased, so is the overall weight of the helmet. Overlap of about 1.0" to 3.0" is preferred in embodiments of the helmet, although less overlap or increased overlap can be utilized in variations thereof.

Figure 9:
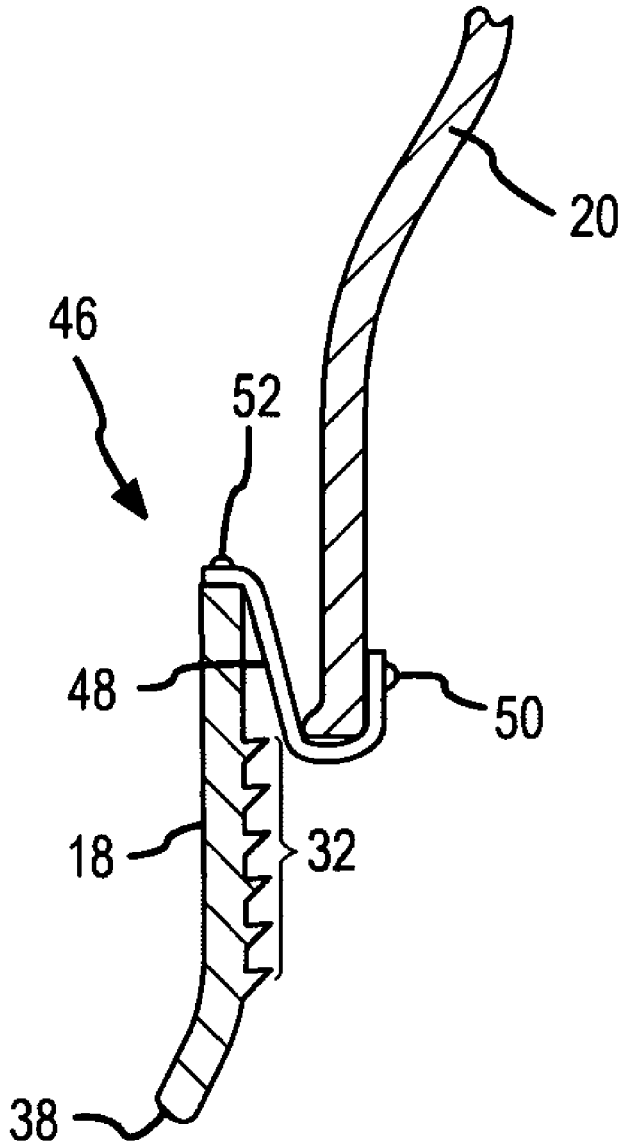
FIG. 9 is a partial cross sectional view taken along line 9-9 of FIG. 3 illustrating a portion of the helmet and the helmet extension illustrating a biasing mechanism according to one embodiment of the present invention.

In general, the force of gravity is enough to return the neck shield 18 into its fully extended normal position after having been fully or partially retracted relative to the shell 20. However, in certain variations, one or more biasing mechanisms 46 can be provided to assist in returning the neck shield to its extended position. In one variation, three biasing mechanisms are provided with one each of the left, right and rear sides of the helmet. Referring to FIG. 9, a cross section of one type of biasing mechanism is illustrated comprising an elastomeric band 48. The elastomeric band is coupled to both the shell and the neck shield by way of a hook (or other connectors) 50 & 52 provided on each respectively. Accordingly, when a wearer tilts his head to the back or the side, the band elongates and applies a counteracting biasing force to urge the neck shield downwardly. Preferably, the biasing force applied by the biasing mechanisms is relatively small and therefore does not significantly interfere with the wearer's head movements.

Other Embodiments and Other Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

The straps can vary significantly from those illustrated and described herein. For instance, bands that are adjustable in length can be used. The bands can have more than one hole at each end through which the threaded or rivet fastener can be received. Accordingly a user can adjust the amount of neck extension overhang. Numerous other length adjustment mechanisms are possible as well as would be obvious to one of ordinary skill in the art with the benefit of this disclosure. Further, the ends of each strap can be reinforced to facilitate a stronger connection with the neck shield and shell respectively. For instance, the strap ends can be encased in a metal ferrule to assist in distributing the load from the strap to the fastener. Further, on variations having biasing mechanisms, the mechanisms can vary substantially in configuration and location. The actual shapes and configurations of the shell and neck extension can vary substantially as well depending on the intended use and required design characteristics of a particular helmet.

In other embodiments of the helmet, the shield can comprise two or more over lapping segments. For instance in one variation, the shield maybe segmented into left and right sections proximate the middle of the helmet's back side. In another variation, the shield could comprise three segments that correspond to the left, right and back sides of the helmet. The segments are overlapped a sufficient amount to prevent gaps from forming therebetween. Additionally, the segments can be coupled to each other via straps or other flexible means. As can be appreciated, each segment is attached to the shell by way of at least two strap assemblies.

While the helmet and associated neck shield described herein relate primarily to combat and/or military use, helmets for other occupations and uses are also contemplated. For instance, a variation of the helmet might be suitable for use by construction workers or workers in any vocation that might have debris flying about. Additionally, the neck shield and its associated hardware (i.e. the straps and fasteners) can be produced and provided separately from the helmet for use in retrofitting current military or civilian helmets.

I claim:

1. A helmet comprising:

a generally hemispherical-shaped rigid shell adapted to fit over the head of a person and cover a substantial portion of the person's crown when worn, the shell comprising a shell bottom rim, a left shell exterior surface, a right shell exterior surface and a back shell exterior surface;

a generally horseshoe-shaped rigid neck shield partially overlapping the shell back exterior surface and at least portions of the shell left and shell right exterior surfaces proximate the bottom rim, the neck shield including a top edge, a bottom edge and a neck shield exterior surface, the neck shield being adapted to cover at least a substantial portion of back and sides of the person's neck when the helmet is worn; and a plurality of elongated straps, each strap having a first end and a second end, the first end of each strap being coupled to one of the left, right and back shell exterior surfaces, the second end of each strap being coupled to the neck shield exterior surface generally proximate the top edge, each strap being substantially straight and vertically disposed when the helmet is being worn by the person when the person is in an upright position;

wherein a first vertical distance between a top fastener of each strap of the plurality of straps and the top edge of the neck shield is equal to or greater than a second vertical distance between the bottom rim of the shell directly below the strap and the bottom edge of the neck shield.

2. The helmet of claim 1 wherein the shell and the neck shield are substantially comprised of a ballistic material.

3. The helmet of claim 2, wherein the neck shield comprises two or more overlapping segments.

4. The helmet of claim 1, wherein the neck shield includes an interior surface and wherein the interior surface comprises a plurality of generally horizontally-extending inwardly projecting ridges located between the top and bottom edges.

5. The helmet of claim 4, wherein the plurality of evenly spaced inwardly projecting ridges are disposed over a portion of the neck shield interior surface.

6. The helmet of claim 4, wherein the neck shield flares outwardly proximate the bottom rim.

7. The helmet of claim 1, wherein each of the plurality of elongated straps comprise woven aramid fibers.

8. The helmet of claim 7, wherein each strap is coated with an ultraviolet inhibiting material.

9. The helmet of claim 1, wherein the plurality of elongated straps comprises four straps with a first strap being located on the left shell exterior surface, a second strap being located on the right shell exterior surface, a third strap being located on the shell back exterior surface closer to the left shell exterior surface than the right shell exterior surface, and a fourth strap being located on the shell back exterior surface closer to the right shell exterior surface than the left shell exterior surface.

10. The helmet of claim 1 further including one or more biasing mechanisms, wherein each biasing mechanism is coupled to both the shell and the neck shield and is configured to bias the neck shield downwardly.

11. The helmet of claim 10 wherein the one or more biasing mechanisms comprise elastomeric bands.

12. The helmet of claim 1, wherein each strap of the plurality of elongated straps are coupled to the shell with one or more rivets.

13. The helmet of claim 1 wherein the first end of each strap is coupled to one of the left, right and back shell exterior surfaces at a first location about 2.5" or more above a second location wherein the second end of each strap is coupled to the neck shield exterior surface generally proximate the top edge.

14. The helmet of claim 1 wherein a distance between interior surfaces of a left portion and a right portion of the neck shield is at least 0.20" greater than a distance between corresponding left and right exterior surfaces of the shell where the neck shield overlaps the shell.

15. An extension for attachment to a military helmet, the extension comprising:

a generally horseshoe-shaped rigid neck shield including a top edge, a bottom edge, an exterior surface and an interior surface, the interior surface including a plurality of generally horizontally-extending inwardly projecting ridges;

a plurality of elongated flexible straps; each strap having a first end and a second end, the first end of each strap being coupled to the exterior surface; and a plurality of attachment means, each attachment means being located proximate the second end of a corresponding strap, the attachment means adapted to couple the strap to the military helmet, the distance between the location wherein the first end is coupled to the exterior surface and the attachment means is about 2.5" or more;

wherein the neck shield is adapted to hang from the plurality of straps when the straps are coupled to the military helmet using the plurality of attachment means with the top edge of the neck shield overlapping the outside surface of the military helmet and the neck shield covering at least a substantial portion of a back and sides of a person's neck.

16. The extension of claim 15, wherein the neck shield has a top portion with a substantially vertical cross section and a bottom portion integral with and extending from the top portion, the bottom portion flaring outwardly proximate the bottom edge.

17. The extension of claim 15, wherein the first end of each strap is coupled to the neck shield proximate the top edge thereof.

18. A military helmet comprising:

a generally hemispherical-shaped rigid shell adapted to fit over the head of a person and cover a substantial portion of the person's crown when worn, the shell comprising a ballistic material and having a shell bottom rim, a left shell exterior surface, a right shell exterior surface and a back shell exterior surface;

a generally horseshoe-shaped rigid neck shield partially overlapping the shell back exterior surface and at least portions of the shell left and shell right exterior surfaces proximate the bottom rim, the neck shield comprising a ballistic material and including a top edge, a bottom edge, a neck shield exterior surface and a neck shield interior surface, the neck shield interior surface including a plurality of horizontally-extending spaced inwardly projecting ridges disposed thereon, the neck shield being adapted to cover at least a substantial portion of back and sides of the person's neck when the military helmet is worn; and three or more elongated straps comprised of a flexible stretch resistant material having a high tensile strength, each strap having a first end and a second end, the first end of each strap being attached to one of the left, right and back exterior surfaces, the second end of each strap being coupled to the neck shield exterior surface generally proximate the top edge, each strap being substantially straight and vertically disposed when the helmet is being worn by the person when the person is in an upright position;

wherein a first vertical distance between an attachment point of each strap of the plurality of straps to the shell and the top edge of the neck shield is equal to or greater than a second vertical distance between the bottom rim of the shell directly below the strap and the bottom edge of the neck shield.

19. The military helmet of claim 18, wherein the neck shield has a generally vertical cross section except for a bottom portion proximate the bottom edge that flares outwardly.

20. The helmet of claim 18 wherein the first end of each strap is coupled to one of the left, right and back shell exterior surfaces at a first location about 2.5" or more above a second location wherein the second end of each strap is coupled to the neck shield exterior surface generally proximate the top edge.

* * * * *